US007234683B2

(12) United States Patent
Schutz

(10) Patent No.: US 7,234,683 B2
(45) Date of Patent: Jun. 26, 2007

(54) HYDRAULIC RESCUE TOOL SUPPLIED BY A BATTERY

(75) Inventor: Christiaan Arnold Schutz, Raamsdonksveer (NL)

(73) Assignee: B.V. Holmatro Industrial Equipment (NL)

( * ) Notice: Subject to any disclaimer, the term of this patent is extended or adjusted under 35 U.S.C. 154(b) by 19 days.

(21) Appl. No.: 10/508,720

(22) PCT Filed: Mar. 21, 2003

(86) PCT No.: PCT/NL03/00218

§ 371 (c)(1),
(2), (4) Date: Jun. 13, 2005

(87) PCT Pub. No.: WO03/080187

PCT Pub. Date: Oct. 2, 2003

(65) Prior Publication Data

US 2006/0108569 A1 May 25, 2006

(30) Foreign Application Priority Data

Mar. 21, 2002 (NL) ..... 1020225

(51) Int. Cl.
*B66F 3/24* (2006.01)
*E21D 15/44* (2006.01)

(52) U.S. Cl. ..... 254/93 R

(58) Field of Classification Search ..... 254/93 R, 254/93 HP; 72/705, 452; 30/228, 366; 29/238–239
See application file for complete search history.

(56) References Cited

U.S. PATENT DOCUMENTS

| | | | | |
|---|---|---|---|---|
| 4,762,304 | A * | 8/1988 | Hill | 254/93 R |
| 5,125,158 | A * | 6/1992 | Casebolt et al. | 30/228 |
| 5,673,898 | A * | 10/1997 | Michalo | 254/93 R |
| 5,810,333 | A * | 9/1998 | Hickerson et al. | 254/93 R |
| 6,000,680 | A * | 12/1999 | Kimura et al. | 254/93 R |
| 6,578,821 | B2 * | 6/2003 | Lasaroff et al. | 254/93 R |
| 2006/0108569 | A1 * | 5/2006 | Schutz | 254/93 R |

* cited by examiner

*Primary Examiner*—Lee D. Wilson
(74) *Attorney, Agent, or Firm*—Myers Dawes Andras & Sherman LLP

(57) ABSTRACT

The invention relates to an electric rescue tool, comprising: a frame (9); a pair of claws (3*a*, 3*b*) mounted movably on the flame; a hydraulic drive cylinder (20) received in the frame; a hydraulic pump (11) fixed to the frame; an electric motor (10) fixed to the frame for driving the hydraulic pump; a control unit (19) for controlling the electrical energy to the electric motor and for controlling valves (23) placed between the hydraulic pump and the drive cylinder, a housing (24, 29); and coupling mechanism for coupling a battery (6) to the electric control unit, wherein the coupling mechanism are adapted to couple a battery placed on the housing to the control unit, whereby the battery can be easily gripped by the person operating the electric rescue tool; the person can grasp the battery with one hand, release and place it for instance in a coat pocket, and then take a fresh battery out of another coat pocket with the same hand and place it on the tool. The person can herein use the other hand to continue holding the tool.

11 Claims, 2 Drawing Sheets

HYDRAULIC RESCUE TOOL SUPPLIED BY A BATTERY

The present invention relates to an electric rescue tool, comprising:

a frame;

a pair of claws mounted movably on the frame;

a hydraulic drive cylinder received in the frame;

a hydraulic pump fixed to the frame;

an electric motor fixed to the frame for driving the hydraulic pump;

a control unit for controlling the electrical energy to be fed to the electric motor and for controlling valves placed between the hydraulic pump and the drive cylinder;

a housing; and coupling means for coupling a battery to the electric control unit.

Such an electric rescue tool is known from EP-A-0 519 845.

This relates to an electric rescue tool wherein the battery is placed in the apparatus.

The consequence hereof is that, when the battery is replaced, the empty battery must be removed from the apparatus and a new, full battery must subsequently be placed in the apparatus.

In view of the fact that rescue tools are usually applied in stressful situations, it is important that the operations that must be performed on such an apparatus are as simple as possible so as to rule out mistakes and thus enable the operations to take place quickly.

It is further pointed out here that electric rescue tools of the above-stated type are applied in situations where no hydraulic pump is available, for example at a great distance from a rescue vehicle.

The object of the invention is to provide such an electric hand tool wherein the replacement of a battery takes place as simply as possible and wherein the chance of errors is as small as possible.

This object is achieved in that the coupling means are adapted to couple a battery placed on the housing to the control unit.

As a consequence of these measures the battery can be easily gripped by the person operating the electric rescue tool; he/she can grasp the battery with one hand, release and place it for instance in a coat pocket, and then take a fresh battery out of another coat pocket with the same hand and place it on the tool. He/she can herein use the other hand to continue holding the tool.

It is pointed out here that the word "battery" is understood to mean an electrochemical cell of the type which is rechargeable. For safety reasons and to prevent leakage it is generally recommended to make use of a dry battery, i.e. a battery of the nickel-cadmium or NiMH type.

According to a first preferred embodiment the coupling means are adapted for coupling to a battery of a type suitable for coupling to other electric tools.

Such batteries are usually applied to drive electrical appliances such as drilling machines, sawing machines and the like. Such machines usually form part of rescue equipment, so that a rescue team already has such batteries available. This achieves a greater measure of interchangeability between the batteries; they can be used for "ordinary" electric tools and for electric rescue tools. Furthermore, use can herein be made of the chargers which are usually already available for batteries of this type.

The prior art electric rescue tool is quite long; this is caused by the fact that the hydraulic cylinder, the hydraulic pump and the electric motor are placed mutually in line one after the other in the electric hand tool. The tool can moreover not be carried on the back, so that its utility is limited. This results in a length of the hand tool such that it is difficult to handle. It must also be taken into account here that the hand tool must be suitable precisely for use in diverse locations with poor access, for instance in order to rescue trapped victims.

A further object of the present invention is therefore to provide such an electric rescue tool that is easier to handle.

This objective is achieved with such an electric rescue tool wherein the frame comprises an elongate element, wherein the hydraulic cylinder is placed parallel to the elongate element, and wherein the electric motor and the hydraulic pump are placed on either side of the hydraulic cylinder.

A compact, light construction method is hereby achieved.

According to a further preferred embodiment, the frame comprises a plate-like element extending transversely of the elongate frame element, the electric motor and the hydraulic pump are mounted on the plate-like element and the electric motor and the hydraulic pump are mutually coupled for driving by means of a connection placed on the side of the plate-like element remote from the motor and the pump.

A simple frame is hereby obtained so that not only is the ease of handling increased but a construction with a low weight is also achieved.

This effect is enhanced when all hydraulic conduits are accommodated in the plate-like element.

According to a further preferred embodiment the electric motor and the pump are mutually connected by means of a belt, wherein the belt extends around the hydraulic cylinder. This construction also results in an optimal use of space.

Yet another preferred embodiment teaches that on the motor side there is placed an auxiliary shaft on which a pulley is placed, wherein the pulley is provided with an internal toothing which engages with a pinion placed on the motor shaft.

This results in an exceptionally space-saving construction; the relatively high rotation speed of the electric motor must be slowed down considerably to the low rotation speed of the hydraulic pump, for which purpose the present construction forms an exceptionally space-saving arrangement.

Yet another preferred embodiment teaches that the electric motor is a direct current motor, wherein the control unit is provided with an electronic power control and wherein the control unit is adapted to allow slow starting of the electric motor.

These measures result in a high efficiency of the energy conversion from electrical energy to mechanical energy, so that the electrochemical energy stored in the battery is optimally used.

The measure that the control unit is adapted to disconnect the battery following a period of rest also results in a similar saving of energy.

The present invention will be elucidated hereinbelow with reference to the annexed drawings, in which.

Figures 1, 4:
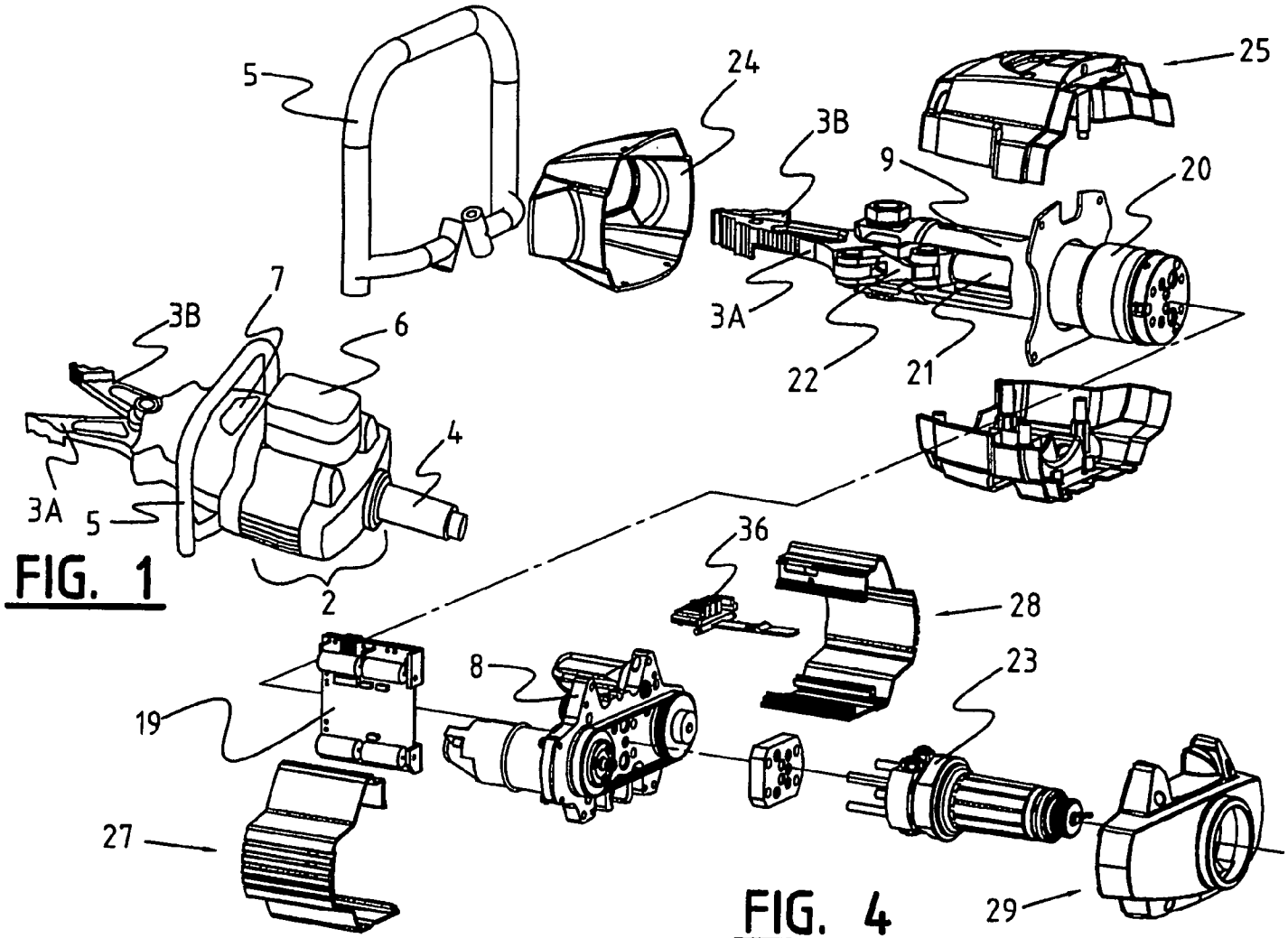
FIG. 1 shows a perspective schematic view of a rescue tool according to the invention.
FIG. 4 shows an exploded view of the rescue tool according to the present invention.
Figure 2:
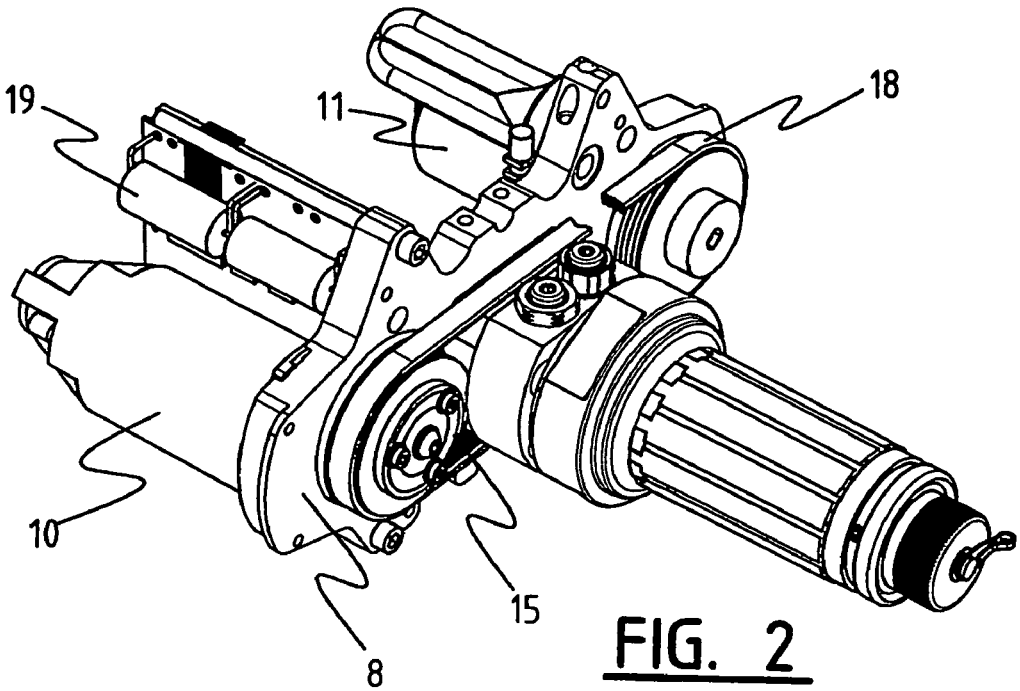
FIG. 2 is a perspective detail view of the internal construction of the rescue tool according to the invention.
Figure 3:
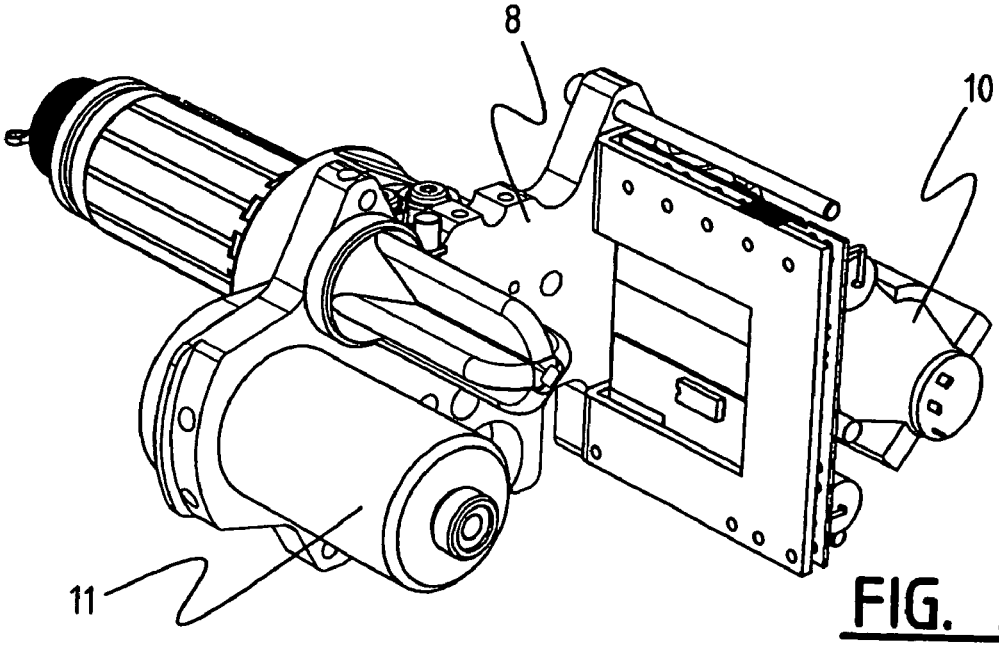
FIG. 3 shows a view corresponding with FIG. 2 of the other view of the interior.

FIG. 1 shows a rescue tool designated as a whole with 1. This rescue tool 1 comprises a housing designated as a whole with 2, on one side of which two claws 3*a*, 3*b* protrude. On the opposite side is arranged a handle 4, while a carrying handle 5 is mounted on the top side. A replaceable battery 6 is placed on top of the housing 2. A switch panel 7 for operating the tool is mounted on the top side under carrying handle 5.

The rescue tool 1 is formed essentially by a frame plate 8 extending in transverse direction of the tool. To this frame plate 8 is fixed the elongate frame 9, in addition to an electric motor 10 and a hydraulic axial plunger pump 11. The output shaft 12 of electric motor 10 extends through frame plate 8, and is provided with a pinion 13 on its end. Mounted on frame plate 8 is an auxiliary shaft 13 on which a pulley 15 is mounted which is provided with an internal toothing that is in engagement with pinion 13.

The pump 11 is provided with a drive shaft which extends through frame plate 8 and on which a pulley 17 is placed. Pulleys 15 and 17 are connected by means of a belt 18. Adjacently of the electric motor 10 there is arranged a printed circuit board 18 on which control electronics are placed. The printed circuit board extends perpendicularly of frame plate 8. The printed circuit board is of course adapted to the heavy working conditions to which it is exposed; it is cast into synthetic resin or provided with an appropriate layer.

The further construction will now be elucidated with reference to FIG. 4. Arranged concentrically to the elongate frame part 9 is a hydraulic cylinder 20, the piston rod 21 of which extends through elongate frame part 9. The end of piston rod 21 is connected by means of a lever system 22 to claws 3*a*, 3*b*. The claws 3*a*, 3*b* are mounted rotatably on the elongate frame part 9.

Carrying handle 5 is also fixed to this elongate frame part 9. Arranged connecting onto the plate-like part 8 is a valve unit 23 which is controllable from the control unit implemented on printed circuit board 19.

The device further comprises a foremost housing part 24, an upper housing part 25, a lower housing part 26, two side housing parts 27, 28 respectively and a front housing part 29. These housing parts can be manufactured from a strong plastic or from aluminium. It is of course important here that the upper housing part is manufactured from plastic so as to avoid short-circuiting when the battery is placed. The upper housing part 25 is further provided with a switch panel 7 behind which is placed a switch unit 30 that is electrically connected to the control unit on printed circuit board 19.

The operation of this device is as follows: starting from a situation in which the battery 6 is fully charged, the switch elements are placed at standby when the tool is switched on by means of switch panel 7. When handle 4 is then rotated, the electric motor 10 will drive the plunger pump 11 until sufficient pressure has been built up to allow work to be performed by claws 3*a*, 3*b*.

The electric motor herein remains switched on, even when a short interval occurs between the operations of the claws 3*a*, 3*b*. Optimum use of energy is hereby achieved, since starting of motor 10 requires a relatively large amount of energy; it is energetically more attractive to allow the motor to idle.

When battery 6 is empty, which is signalled by LEDs present on the switch panel, the batteries can be easily changed due to the easily accessible placing thereof. The present invention is otherwise not limited by the use of the claws 3*a*, 3*b*; it is of course possible to use other types of claw, or use an entirely different type of tool.

In addition, due to the relatively short construction method an easily handled tool is obtained which is furthermore light. The tool can be handled by grasping the handle 4, in which the valve unit 23 for the hydraulic cylinder is placed, and the carrying handle 5.

The invention claimed is:

1. Electric rescue tool, comprising:

a frame;

a pair of claws mounted movably on the frame;

a hydraulic drive cylinder received in the frame;

a hydraulic pump fixed to the frame;

an electric motor fixed to the frame for driving the hydraulic pump;

a control unit for controlling the electrical energy to the electric motor and for controlling valves placed between the hydraulic pump and the drive' cylinder;

a housing; and coupling means for coupling a battery to the electric control unit, characterized in that the coupling means are adapted to couple a battery placed on top of the housing to the control unit.

2. Electric rescue tool as claimed in claim 1 characterized in that:

the frame comprises an elongate element;

the hydraulic cylinder is placed parallel to the elongate element; and the electric motor and the hydraulic pump are placed on either side of the hydraulic cylinder.

3. Electric rescue tool as claimed in claim 2, characterized in that the frame comprises a plate shaped element extending transversely of the elongate frame element;

the electric motor and the hydraulic pump are mounted on the plate shaped element, and the electric motor and the hydraulic pump are mutually coupled for driving by means of a connection placed on the side of the plate shaped element remote from the motor-and pump.

4. Electric rescue tool as claimed in claim 3, characterized in that a number of hydraulic conduits are accommodated in the plate shaped element.

5. Electric rescue tool as claimed in claim 3 characterized in that the electric motor and the pump are mutually connected by means of a belt, wherein the belt extends round the control of the hydraulic cylinder.

6. Electric rescue tool as claimed in claim 5, characterized in that on the motor side there is placed an auxiliary shaft on which a pulley is placed, wherein the pulley is provided with an internal toothing which engages with a pinion placed on the motor shaft.

7. Electric rescue tool as claimed in claim 1, characterized in that the control unit is placed on a printed circuit board extending transversely of the frame, plate and placed adjacently of the electric motor.

8. Electric rescue tool as claimed in claim 1, characterized in that the electric motor is a direct current motor, that the control unit is provided with an electronic power control and that the control unit is adapted to allow slow starting of the electric motor.

9. Electric rescue tool as claimed in claim 7, characterized in that the control unit is adapted to switch off the electric motor only after a predetermined period of time.

10. Electric rescue tool as claimed in claim 1, characterized in that the control unit is adapted to disconnect the battery automatically following a period of rest.

11. Electric rescue tool as claimed in claim 1, characterized in that the coupling means are adapted for coupling to a battery of a type suitable for coupling to other electric tools.

* * * * *